US005513458A

United States Patent [19]

Dehli

[11] Patent Number: 5,513,458

[45] Date of Patent: May 7, 1996

[54] ADVERTISING DISPLAY APPARATUS WITH PRECISE ROTARY DRIVE

[75] Inventor: Hans J. Dehli, Dana Point, Calif.

[73] Assignee: Admotion Corporation, Irvine, Calif.

[21] Appl. No.: 153,127

[22] Filed: Nov. 15, 1993

[51] Int. Cl.[6] ..... G09F 19/00

[52] U.S. Cl. ..... 40/470; 40/437

[58] Field of Search ..... 40/436, 437, 442, 40/445, 476, 488, 509, 470

[56] References Cited

U.S. PATENT DOCUMENTS

| | | |
|---|---|---|
| 609,915 | 8/1898 | Sibley . |
| 1,172,360 | 2/1916 | Hildburgh . |
| 1,172,455 | 2/1916 | Hildburgh . |
| 1,322,542 | 11/1919 | Chauvet . |
| 1,594,703 | 8/1926 | Ballerini . |
| 1,938,899 | 12/1933 | Gilman . |
| 2,149,779 | 3/1939 | Kroner . |
| 2,151,055 | 3/1939 | Stark . |
| 2,163,188 | 6/1939 | Bosche . |
| 2,263,281 | 11/1941 | Von Tadden . |
| 2,605,965 | 8/1952 | Shepherd . |
| 2,645,047 | 7/1953 | O'Gorman . |
| 2,982,038 | 5/1961 | Kass . |
| 2,989,680 | 6/1961 | Weiser et al. . |
| 3,000,125 | 9/1961 | Elvestrom . |
| 3,014,302 | 12/1961 | Hughes . |
| 3,054,203 | 9/1962 | French . |
| 3,082,560 | 3/1963 | Elvestrom . |
| 3,086,306 | 4/1963 | Morgan . |
| 3,110,893 | 11/1963 | Peacock . |
| 3,572,925 | 3/1971 | Ables et al. . |
| 3,683,525 | 8/1972 | Fukui . |
| 3,742,631 | 7/1973 | Hasala . |
| 3,747,243 | 7/1973 | Schneider . |
| 3,862,504 | 1/1975 | Ringelheim et al. . |
| 3,883,966 | 5/1975 | Ludwig . |
| 3,902,901 | 9/1975 | Vogel . |
| 3,918,185 | 11/1975 | Hasala . |
| 3,953,764 | 4/1976 | Miller et al. . |
| 3,961,434 | 6/1976 | Sampon . |
| 4,050,809 | 9/1977 | Boggs . |
| 4,118,879 | 10/1978 | Simon . |
| 4,263,737 | 4/1981 | Simon . |
| 4,267,489 | 5/1981 | Morohashi . |
| 4,306,226 | 12/1981 | Swarbrick . |
| 4,491,434 | 1/1985 | Barr et al. . |
| 4,508,802 | 4/1985 | Heiart et al. . |
| 4,542,376 | 9/1985 | Bass et al. . |
| 4,616,327 | 10/1986 | Rosewarne et al. . |
| 4,620,288 | 10/1986 | Welmers . |
| 4,637,974 | 1/1987 | Kubit . |
| 4,860,471 | 8/1989 | Bonanomi ..... 40/470 X |
| 4,897,802 | 1/1990 | Atkinson et al. . |
| 5,100,330 | 3/1992 | Sekiguchi . |

*Primary Examiner*—Brian K. Green
*Attorney, Agent, or Firm*—Fulwider Patton Lee & Utecht

[57] ABSTRACT

An advertising display apparatus with precise rotary drive includes a programmable stepper motor positively coupled to a pair of eccentric drives. Rotation of the eccentric drives moves a film sheet containing discrete images formed from corresponding sets of pixels through a closed loop path across a platen stopping at precise dwell points. At each dwell point, a set of pixels register with a plurality of apertures within an overlying grid sheet and are illuminated by a light source within the apparatus to display the image.

24 Claims, 5 Drawing Sheets

ADVERTISING DISPLAY APPARATUS WITH PRECISE ROTARY DRIVE

BACKGROUND OF THE INVENTION

1. Field of the Invention

The present invention relates to an apparatus and method for sequentially displaying multiple high resolution images in a single display and more particularly to an improved drive means for such a display apparatus.

2. Description of the Prior Art

A great demand has arisen for display advertising using animation and multiple advertisements at individual popular display locations thereby enabling a number of advertisers to benefit from a single location. Numerous different methods and devices have been proposed for preparing and displaying such advertisements. Many such devices involve relatively unwieldy mechanical elements driven by complex drive mechanisms which often generate noise at an annoying level. In addition to the expense of original manufacture, the user is often faced with expensive maintenance.

Typically, these devices are used in public retail outlets or other public locations. It is desirable to display multiple advertising images wherein the exchange from one image to another is nearly instantaneous thereby enabling the sequential display of different images in a manner where the exchange is imperceptible to the human eye from a distance of several feet and beyond from the display. Such a sequential display tends to draw and hold a viewer's attention without an annoying perception that one view is being broken up and another assembled.

Display devices have included transparency sheets having images thereon illuminated by back lighting through an overlay mask which blocks the back lighting from illuminating certain areas of the transparency sheets. Animated displays have included a grid having alternate opaque and transparent strips and a photographic transparency on which discrete images are arranged in parallel image strips which are moved relative to one another to give the impression of animation. The image strips of the photographic transparency are wider than the transparent strips of the grid. When the center lines of a set of image strips are aligned with the transparent lines of the grid, only three fifths of each strip is visible. Thus, some image information is lost. A device of this type is shown, for example, in U.S. Pat. No. 3,742,631 to Hasala. Because the image strips are only moved laterally, for a display of more than two images from one composite mosaic, the relative travel between the mask of transparent sheets must be considerable adding to the noise level and generating unwanted movement likely to distract the viewer.

Display devices have also included a grid moved in a square pattern over a transparent sheet to display a series of images selected from a composite of individual images. The transparent sheets are fully developed with several different appearances making up the visual display. A drive motor is utilized to drive a cam and cam follower to move the grid. The mechanical confrontation between the cam follower and the cam on the drive motor is loose and lacks precision. A device of this general type is shown in U.S. Pat. No. 4,306,226 to Swarbrick. Because of the lack of precision in relative movement, the apertures in the grid are made smaller than the pixels of the transparent sheet to account for errors in grid placement when the grid is shifted over the transparent sheet.

Devices have been proposed which include translucent image screens made up of mosaics of discrete images formed by interlaced translucent pixels which are arranged in uniform groups. Pixels corresponding to an image occupy the same relative position in each group. The image screen is covered with an opaque screen having a uniform pattern of transparent apertures. The opaque screen blocks back lighting from shining through the image screen except through the apertures. The uniformly patterned apertures are then aligned with pixels which correspond to an image and the image is thereby displayed by the back lighting shining through the image screen and the apertures. The opaque screen is selectively shifted on the image screen such that the apertures align with the pixels of a different image. A device of this general description is shown in U.S. Pat. No. 4,897,802 to Atkinson et al. Notwithstanding the excellent operational characteristics of the aforementioned patent, it is desirable to have a better drive system enabling precise and accurate registration between such an image screen and the opaque screen.

SUMMARY OF THE INVENTION

The present invention is directed to a sequential picture selection apparatus with precise rotary drive positively coupled to remote eccentric drives for continued rotation in one direction to achieve forward travel through a closed loop path. The apparatus includes a housing having a light source mounted rearwardly therein and shining forwardly through a window and a platen over which a mosaic of sets of tiny pixels is movably mounted and to be sandwiched between such platen and a stationary grid sheet having apertures which are simultaneously registerable with pixels of corresponding sets to collectively project discrete images. A precision stepper drive motor is coupled with at least one eccentric which engages and drives the mosaic sheet through a predetermined closed loop path to sequentially move the mosaic sheet relative to the grid in a manner to sequentially register the respective individual pixels of the sets with the respective apertures. A control device is provided which connects with a stepper drive motor and is operative to stop the drive motor in dwell positions with the respective corresponding pixels of the pixel sets registered with the respective apertures. In the preferred embodiment, the stepper motor is operative to be reset to a predetermined home position during each revolution. The stepper motor drive shaft may be coupled with the eccentrics by means of timing belts.

Other features and advantages of the invention will become apparent from the following detailed description, taken in conjunction with the accompanying drawings, which illustrate, by way of example, the features of the invention.

BRIEF DESCRIPTION OF THE DRAWINGS

FIGS. 11–18 are diagrammatic views of pixel patterns incorporated in a grid and film sheet of a second embodiment of the present invention.

DESCRIPTION OF THE PREFERRED EMBODIMENT

Figure 1:
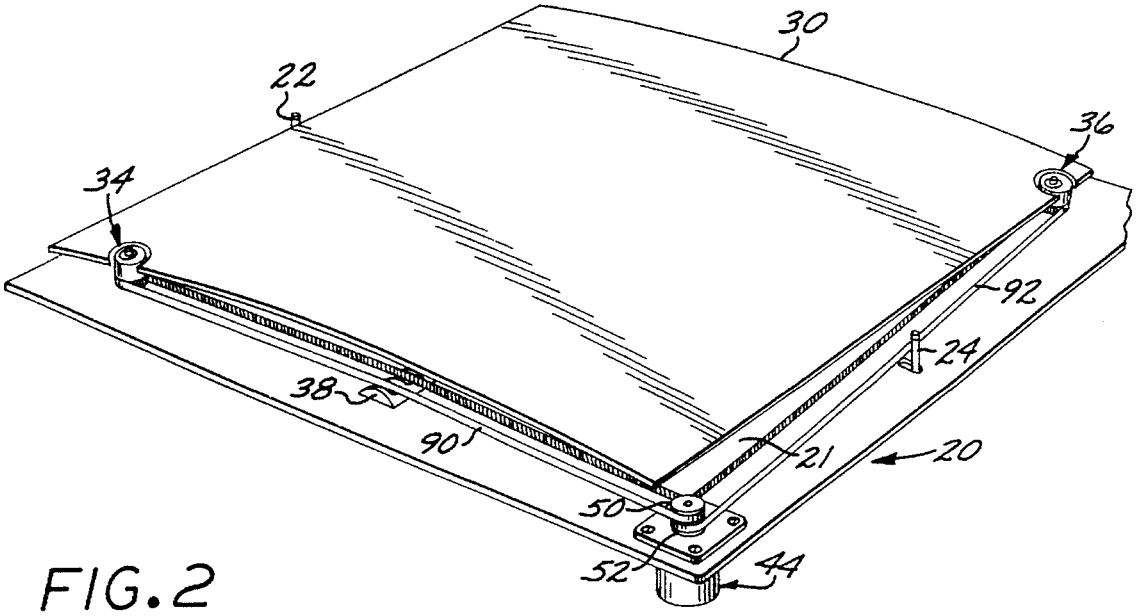
FIG. 1 is a perspective view of a display apparatus according to the present invention.

As shown in the drawings for purposes of illustration, the invention is embodied in a precise rotary drive for shifting a translucent film sheet in one direction around a closed loop pattern under an opaque grid sheet having a plurality of display apertures to sequentially display discrete images formed in the film sheet.

The film sheet comprises pixels of discrete images interspersed with pixels of other discrete images. The images are sequentially displayed by relative movement between the film sheet and the grid sheet such that the display apertures of the grid sheet precisely align with pixels corresponding to a particular image to be displayed. The film sheet is illuminated only through precisely located apertures in the grid sheet for projection only through the pixels which are aligned with the apertures. When the grid apertures register with a specific set of pixels, one discrete image is displayed.

The film sheet is moveable on a platen securely mounted on a frame housed in an illuminated display housing. The platen is formed of a sturdy translucent surface with circular indentations disposed therein for receipt of two remote cylindrical heads. The film sheet has followers formed therein for pivotal receipt of pins movably mounted on and displaced from a central axis of each remote head.

In accordance with the present invention, a stepper motor includes a motor shaft having two linked sprocket wheels non-rotatably mounted thereon. Each sprocket wheel is coupled through a respective toothed timing belt to an eccentric drive including an eccentrically located pin. As the eccentric drives are controllably rotated through a pattern of dwell points, the respective pins drive the film sheet about a predetermined closed loop pattern stopping at precise, discrete positions.

Figure 2:
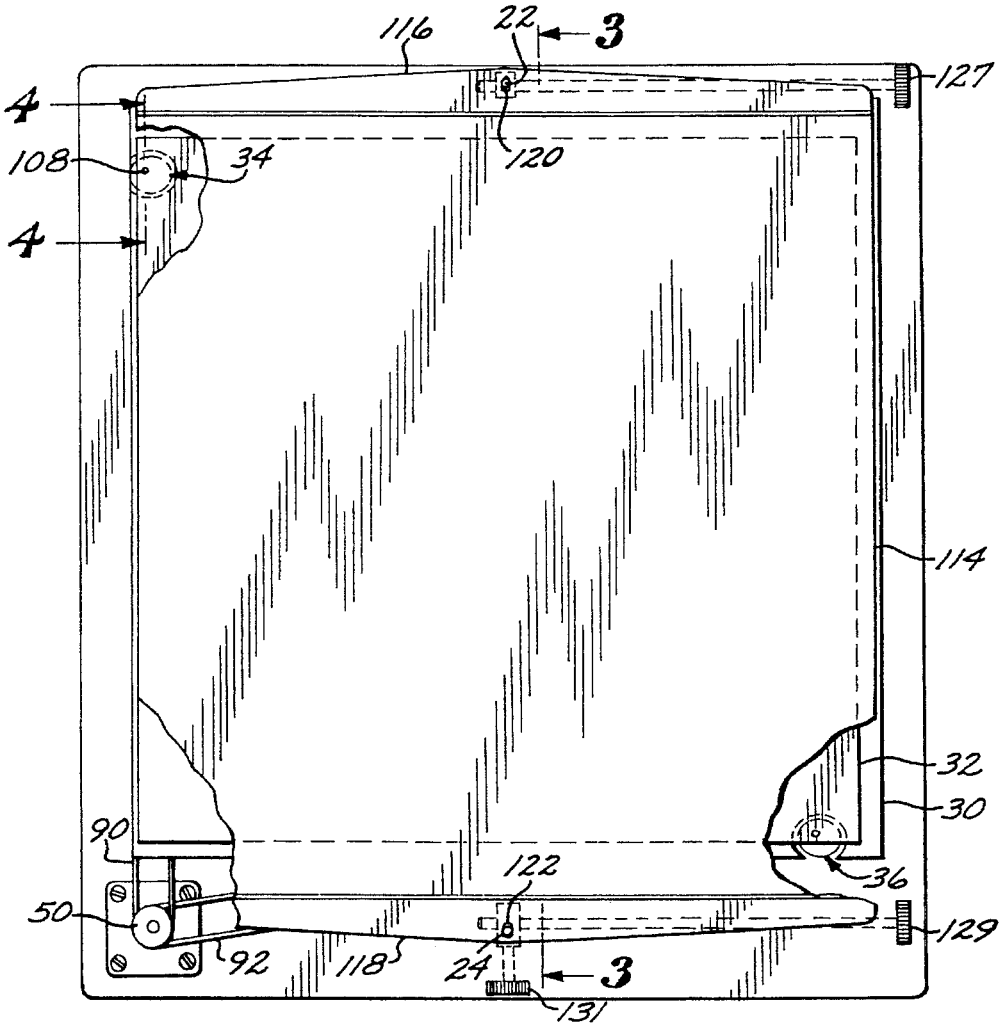
FIG. 2 is a top plan view, in enlarged scale, partially cut away, of the display apparatus shown in FIG. 1 showing a frame, a platen, a film sheet, and a grid sheet.
Figure 3:
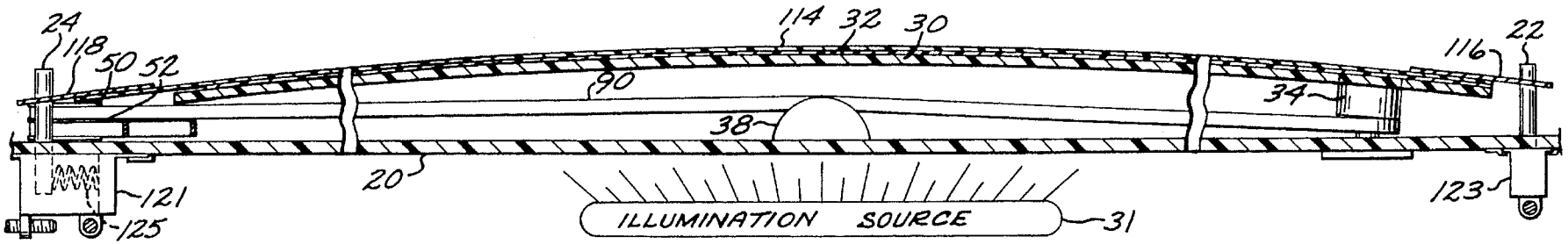
FIG. 3 is a cross-sectional view, in enlarged scale, taken along line 3—3 of FIG. 2.
Figure 5:
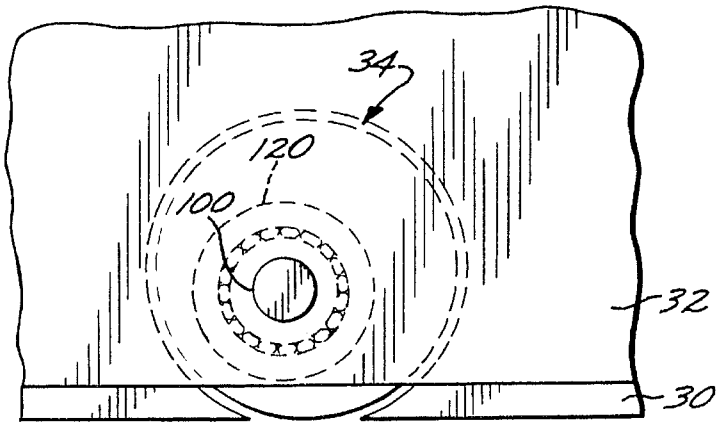
FIG. 5 is a horizontal sectional view taken along line 5—5 of FIG. 4.
Figure 6:
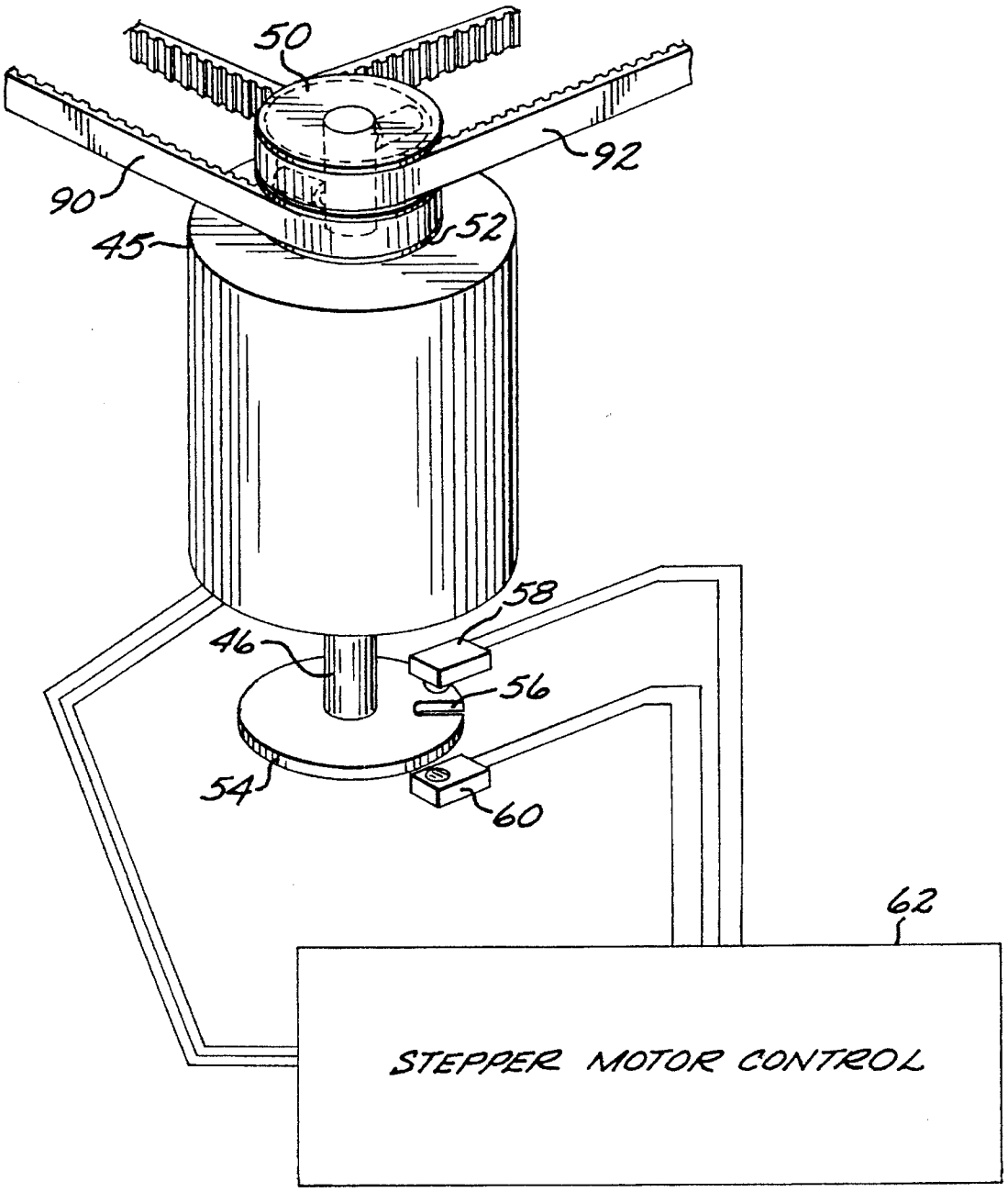
FIG. 6 is a perspective view, in enlarged scale, of the stepper drive motor included in the apparatus shown in FIG. 1.
Figure 7:
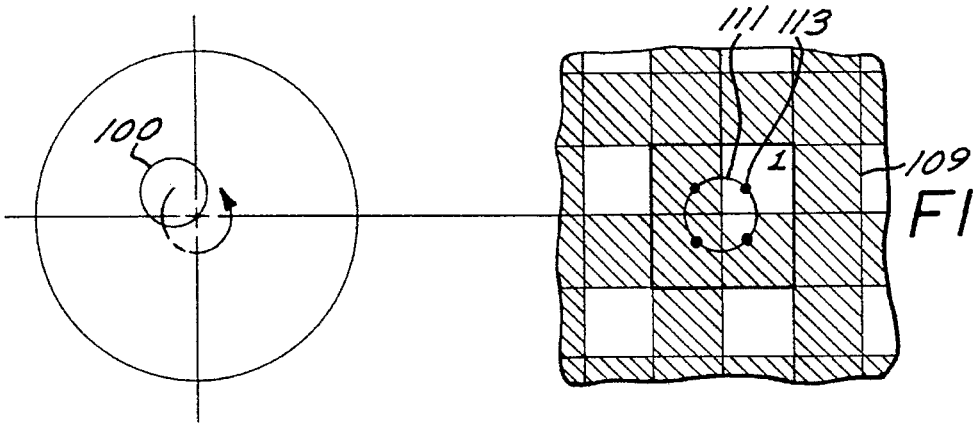
FIGS. 7–10 are diagrammatic views of the eccentric drive of FIG. 4 showing the eccentric drive and the film sheet in four different stop positions respectively.

Referring to FIGS. 1–3, the apparatus of the present invention includes, generally, an open center square frame 20 for setting in a housing to form part of such housing and formed centrally with a window 21 over which is mounted an arcuately shaped transparent platen 30 for projection therethrough of light from fluorescent tubes 31. Mounted at the diagonally opposite corners of the frame are respective eccentrics, generally designated 34 and 36, which are operative to shift a translucent photographic mosaic film sheet 32 through a circular path underneath a grid sheet, generally designated 114. The respective eccentrics 34 and 36 are coupled with a pair of sprockets 50 and 52 (FIG. 6) fixedly attached to the drive shaft 46 of a step motor, generally designated 44, by means of timing belts 90 and 92. A control circuit housed in a control box 62 (FIG. 6) is connected with the step motor 44 to stop the step motor at dwell points where corresponding pixels in the film sheet 32 cooperating to form the image to be projected are positioned in alignment with the respective apertures of the grid screen 114.

The platen 30 may be constructed of translucent acrylic material and is convexed upwardly to cause the tension pins 22 and 24 to draw the grid sheet 114 down firmly on the image sheet 32 to apply slight tensioning thereto and maintain the image sheet relatively firmly pressed against the surface of the platen to maintain it to prevent puckers, ripples or waves therein which might negatively affect the projection of light through the pixels and apertures.

Figure 4:
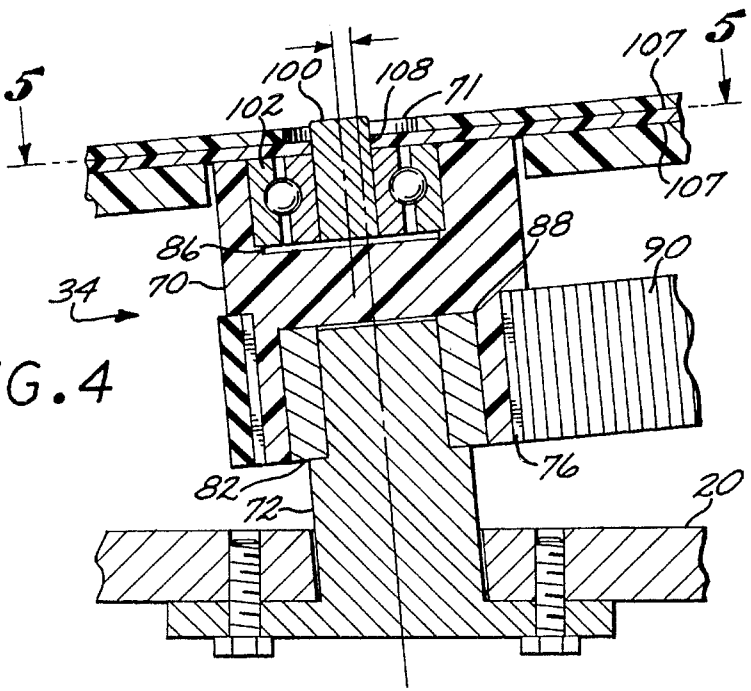
FIG. 4 is a vertical sectional view, in enlarged scale, taken along line 4—4 of FIG. 2.

Referring to FIG. 4, the eccentrics 34 and 36 are mounted from the frame 20 by means of mounting stems 78. Such eccentrics are in the form of cylindrical heads, generally designated 70, carried from the stems and formed in their exposed ends with respective eccentrically located counterbored bore defining cavities 86 offset from the rotational axis of the respective wheels by a distance corresponding with one-half the cross-sectional dimension of a pixel. Press fit into the cavity 86 is the outer race of a ball bearing assembly generally designated 102. Press fit into the center race of such ball bearing are respective eccentric pins 100 which project outwardly beyond the projecting ends of the respective heads 70 to be received in press fit relation with eccentric drive holes 108 formed at diagonally opposite corners of the film sheet 32. Formed in the bottom of the respective heads 70 are respective bores 82 into which bronze bushings 88 are press fit which provide for free rotation on the respective mounting stems 78. Formed in the periphery of the respective heads 70 at the bottom portion thereof are respective toothed grooves 76 which define sprockets for meshing with the teeth of the respective timing belts 90 and 92.

The grid sheet 114 is formed adjacent to its diagonally opposite corners with respective clearance bores 71 (FIG. 4) which overlie the respective eccentrics 34 and 36 and provide clearance for orbiting of the respective eccentric drive pins 100 which engage and drive the film sheet 32.

Referring to FIG. 3, mounted centrally on the sides of the frames defining the run for the respective timing belts 90 and 92 are respective guides 38 which deflect the medial runs of the respective belts upwardly to cause the belts leading away from the respective sprockets 76 to assume a straight run out from such sprockets and maintain such belts threaded over the respective sprockets.

The rotary stepper motor 44 (FIGS. 1 and 6) is a conventional DC motor having a cylindrical body 45 mounted to a corner of the frame 20. The stepper motor shaft 46 (FIG. 6) protrudes from one end of the stepper motor body 45 to project through the frame and through a mounting bracket 48 (FIG. 1). First and second sprockets 50 and 52 (FIGS. 1 and 6) are mounted on the projecting end of the motor shaft 46. The two sprocket wheels 50 and 52 are keyed to the motor shaft 46 by respective set screws. When the screws are tightened, the sprocket wheels 50 and 52 are locked.

A timing wheel 54 (FIG. 6) is mounted on a second end of the motor shaft 46 on the back side of the motor 44. The timing wheel is a circular rotor disk. The disk is formed with a radial timing notch 56 for selected projection therethrough of an infrared timing beam.

The stepper motor 44 (FIGS. 1 and 6) rotates the motor shaft 46 counterclockwise. The motor shaft 45 stops at four dwell positions along the 360° circuit, with 0° being 12 o'clock high. Each dwell position is separated by 90°. Position 1 is 45°. Position 2 is 315°. Position 3 is 225°. Position 4 is 135°. The stepper motor 44 rotates the motor shaft 46 through 200 precise steps per revolution, each being 1.8 degrees of rotation. Fifty stepped increments rotate the motor shaft the required 90° between the dwell positions. The dwell duration at each dwell position is 0.5 seconds and up. The drive motor 44 circuitry is responsive to control pulses to rotate the drive shaft 46 at a precise speed to advance and stop at the 200 discrete precise positions per revolution. The stepper motor is electrically coupled to a stepper motor controller 62. The motor shaft 46 is advanced one step for each command pulse received by the drive motor 44.

A miniature infrared transmitter 58 and a receiver 60 (FIG. 6) are mounted beneath the body 45 of the stepper motor 44 on opposite sides of the timing wheel 54 so that infrared radiation emissions are directed at the timing wheel to project through the notch 56 once each revolution. The infrared receiver 60 is responsive to receipt of infrared radiation from the infrared transmitter 58 to pass a receiver signal to the stepper motor controller 62.

Control buttons (not shown) are mounted on the display housing control panel to control the stepper motor controller circuitry enabling an operator of the display apparatus to select the precise rotation speed of the motor driven motor shaft 46 (FIG. 6), the number and location of precise dwell positions within a turn cycle, and the dwell duration. The stepper motor controller 62 includes a microprocessor driven circuit board. A drive control program stored as firmware within the microprocessor controls the stepper motor to generate command pulses at a predetermined time and rate. The drive control program is responsive to commands from the user interface control buttons coupled to the stepper motor controller 62.

The stepper motor controller 62 includes a memory and a counter to count the steps moved by the rotating motor shaft 46. After the motor shaft completes the 200 steps of a complete revolution, the stepper motor controller generates a reset signal and senses to determine if the timing wheel slot 56 has physically completed a precise revolution and been returned to its home position, position one. The control program controls a feedback circuit portion of the circuit board utilizing a find home routine. The feedback circuit is responsive to the reset signal to control the infrared transmitter 58 to transmit to an infrared receiver 60 as the motor 44 is commanded by the controller 62 to rotate the timing notch 56 on the timing wheel 54 through a 360° rotation. The stepper motor controller 62 attempts to detect the receiver signal to insure that the motor shaft 46 is lodged at home position. If the receiver signal is not detected, the motor shaft 46 continues to rotate the timing wheel rotor 54. When the leading edge of the notch 56 moves between the transmitter 58 and the receiver 60, the infrared signal is received and that position of the motor shaft is stored as the correct home position in memory.

It is important that the timing belts 90 and 92 (FIG. 1) are inelastic and are formed with respective sets of teeth that mesh with the respective teeth of drive sprockets 50 and 52 and respective driver sprockets 76 of the eccentrics 34 and 36. Since this linkage is relied on to positively translate the precise positioning of the drive sprockets 50 and 52 to the respective eccentrics 34 and 36 without any other peripheral stops, it is important that the connection be precise without undue play or elasticity on the connection.

Figure 8:
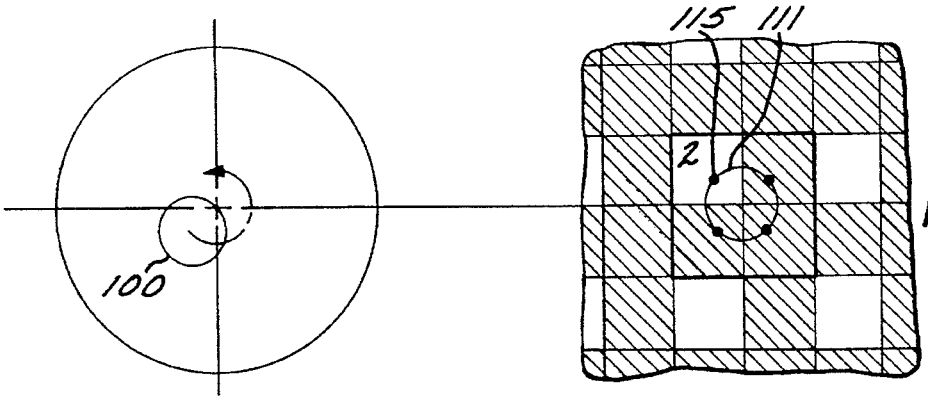
Figure 9:
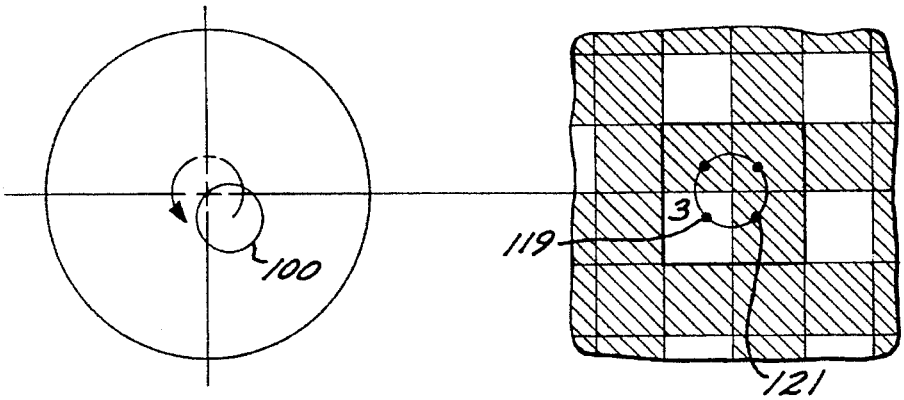
Figure 10:
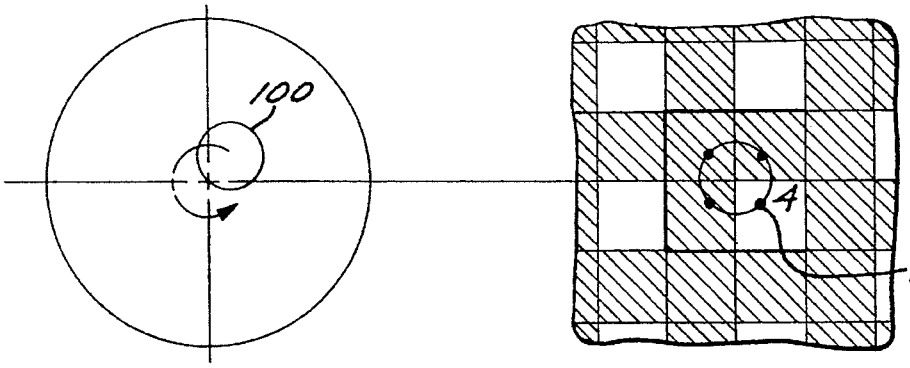

The grid film sheet 32 may be of the type shown in U.S. Pat. No. 4,897,802 to Atkinson and assigned to the assignee of the rights in the instant invention. The sheet is photographically prepared to form four discrete images formed from sets of pixels corresponding to the discrete image interlaced with other sets of pixels corresponding to other discrete images. Each pixel 109 of the set of four is square, having a dimension of 0.039 inches (1 mm) on a side. Each square four pixel group has a dimension of 0.078 inches on a side. Referring to FIGS. 7–10, the eccentrics 34 and 36 are constructed with respective drive pins having an eccentricity equal to one-half the width of the respective width of the respective square pixels 109 such that the respective eccentric pins are orbited through a circle having a diameter equal to the width of a full square. The image components of the respective images may be broken down to pixel positions depicted in FIGS. 7–10 as positions 1, 2, 3, and 4. Referring to FIG. 1, with the grid sheet 114 in the position with the respective apertures in alignment with the corresponding pixels of position "one" of each of the four pixel sets, the composite image corresponding with the composite of pixels in position "one" will be displayed. It will be appreciated that the film sheet 32 is then rotated through a circular pattern 111 (FIG. 7) in the counterclockwise direction resulting in such sheet being rotated upwardly and to the left from position number "one" 113 to move 90° on the pattern 111 to the second position 115 where it may again dwell to display the composite image corresponding with the pixels in position number "two" (FIG. 8). The process is then continued for the dwell positions 119 and 121 corresponding with the pixels in position numbers "three" and "four" depicted in FIGS. 9 and 10, respectively. The arc of movement of a pixel from one dwell position to the next along the circular pattern 111 is small, approximately 0.2 mm. This ensures that non-selected pixels are not momentarily illuminated as the film sheet is moved along the circular pattern 111. In the preferred embodiment, the film sheet 32 is sprayed on its opposite sides with a dry lubricant 107 such as a Teflon lubricating film. With this arrangement, the eccentrics 34 and 36 may be coupled directly to such film by, for instance, the eccentrically mounted pins 100 to drive the relatively light film sheet about its path applying a relatively small force of only about 200 grams.

The square photographic grid sheet 114 (FIGS. 2, 3 and 4) may be of the type shown in the Atkinson patent and has photographically imposed horizontal and vertical opaque members regularly spaced to form apertures. The dimensions of each aperture corresponds to the dimensions of each pixel. The square photographic grid sheet 114 overlies the film sheet 32 and the platen 30 (FIGS. 2, 3 and 4). The grid sheet 114 has glued to its opposite sides angle handle bars 116 and 118 (FIG. 2) having respective diamond shaped mounting holes 120 and 122 formed in the respective horizontal flange thereof. The receiving holes 120 and 122 receive the respective retaining pegs 22 and 24.

The mounting pegs 22 and 24 are floatingly carried from respective mounting blocks 121 and 123 mounted under the frame 20 and project upwardly through oversize slots in such frame. The peg 22 is biased outwardly away from the platen 30 by a spring 125 (FIG. 3) to thus maintain a slight tension on the flexible grid sheet 114.

Referring to FIG. 2, an adjustment mechanism is provided to floatingly move the grid sheet 114 with respect to the stationary underlying platen 30 (FIG. 2). A pair of knurled thumb wheels 127 and 129 threadedly engage floating blocks on which the respective pegs 22 and 24 are mounted so that lateral adjustment may be made by rotating such knob.

A vertical adjustment knob 131 is carried from the bottom side of the frame 20 (FIG. 2) for manipulating the pin 24 up and down to draw the grid sheet 114 relative to the floating top peg 22 to shift the grid sheet vertically.

Synchronization of the relationship between the stepper motor and the eccentric drives is a final step in the manufacturing of the display apparatus. The set screws on the motor shaft are loosened freeing the sprocket wheels 50 and 52 (FIG. 6) to free wheel. The belts 90 and 92 are installed and the stepper motor shaft 46 driven to its home position, position number one, corresponding to the position of the slot 56 in the timing wheel 54 (FIG. 6) disposed in alignment between the infrared transmitter 58 and receiver 60. The stepper motor controller 62 recognizes and records this position. The sprocket wheels 50 and 52 are each manually rotated to a position 45 degrees counterclockwise from 12 o'clock high, corresponding to home position number "one" and the set screws are tightened locking the sprocket wheels 50 and 52 on the motor shaft.

To operate the advertising display apparatus of the present invention, the user opens the housing cover of the display apparatus and removes the grid sheet 114 from the retaining pegs 22 and 24. A film sheet containing the desired images is then placed in overlying relation on the platen 30. The follower holes 108 (FIG. 4) of the film sheet are received in tight fit over the pins 100 of the eccentric drives 34 and 36. The user then mounts the grid sheet 114 over the selected film sheet 32 by fitting the top opening 120 over the peg 22 and drawing such peg toward the lower peg 24 to then snap the lower opening 122 over the peg 24. The adjustment knobs 127, 129 and 131 are then adjusted to float the grid sheet into position focusing the apertures in alignment over the respective corresponding pixels 109 of the sets of pixels.

The user then turns the power switch on the control panel to "on". The film sheet is automatically driven to position "one", home position. The user selects the run mode of operation by depressing a button on the control panel. The user then selects the number of advertising images, for instance four, and programs the display time of each image corresponding to the dwell duration of the film sheet at each dwell point. The user selects automatic control of the advance rate of the motor shaft by the stepper motor controller. Alternatively, the advance rate is also controllable and selectable by the user.

It will be appreciated that the stepper motor 44 will then advance in increments to transmit the rotative motion through the drive sprockets to the timing belts 90 and 92 and to the sprockets of the eccentrics 34 and 36 to advance such eccentrics precisely 90° about the circular pattern 111. At each of the dwell points 113, 115, 119 and 121 (FIGS. 7–10), the stepper motor will stop and dwell to provide for momentary viewing of the composite image projected from the corresponding sets of pixels. This precise advancement is relatively noise free and results in relatively minor wear on the moving components. Additionally, since the belts 90 and 92 and sprockets 76 (FIG. 4) move in the same rotative direction without reversing, any relative wear between such sprockets and the belts will be on the same sides of the respective teeth so that the resultant wear will have little or no effect on the precision with which the drive sprockets drive the eccentric slave sprockets.

Figure 16:
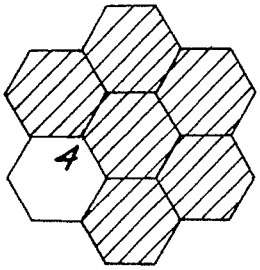
Figure 17:
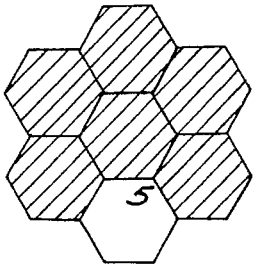
Figure 16:
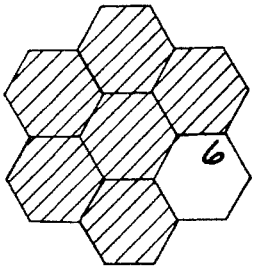
Figure 18:
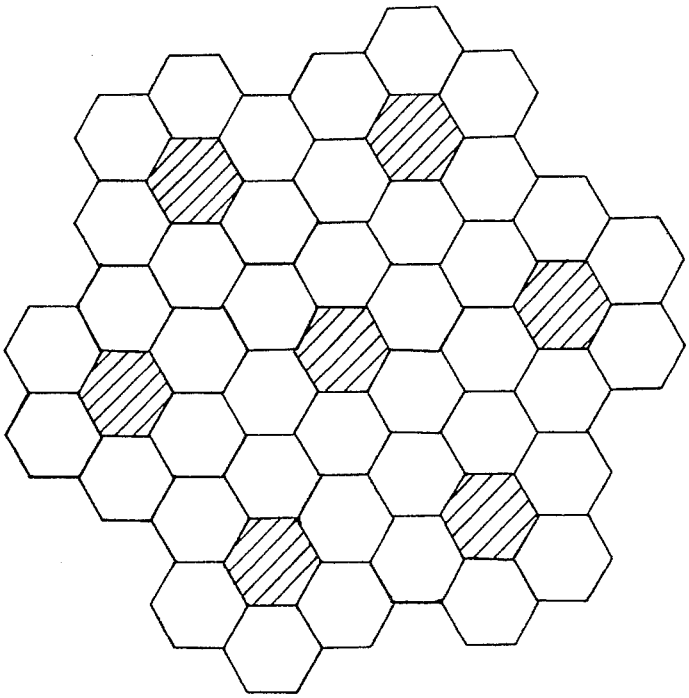

In an alternate embodiment, the film sheet is photographically configured to form six discrete images (FIGS. 11–18). Each of the six discrete images is a composite of a set of pixels. The set of pixels are interlaced with other sets of pixels corresponding to other discrete images (FIG. 18). The pixels of the sets are arranged in uniform groups 130 (FIG. 11) of pixels such that pixels from any one image are located in corresponding positions in each group. Each pixel 132 of the group is of hexagonal shape. Each side of the hexagonal pixel is of dimension 0.5 mm in length. The area of each hexagonal pixel is 0.6495 $mm^2$. The groups of pixels in the six image embodiment are of hexagonal shape with six pixels, each corresponding to one of the six discrete composite images, being disposed around the perimeter of the hexagonal group 130. Within each hexagonal group of pixels, there is a null point 134 (FIG. 11) containing no data. In this embodiment, the apertures of the overlying grid sheet are hexagonal and correspond to the dimensions of the hexagonal pixels.

Figure 12:
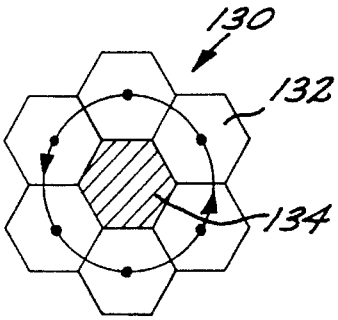
Figure 13:
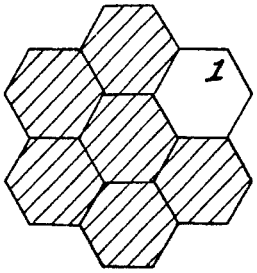
Figure 14:
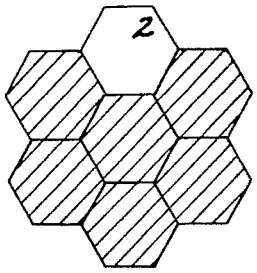
Figure 15:
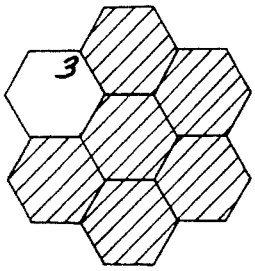

The stepper motor is programmable to sequentially rotate the motor shaft counterclockwise to six dwell positions in the six image embodiment. With 0/360 degrees being high noon, position one is 45 degrees clockwise. Position two is 345 degrees. Position three is 285 degrees. Position four is 225 degrees. Position five is 165 degrees. Position six is 105 degrees. Six pixels corresponding to six discrete images are shown in sequence within one hexagonal aperture of the grid sheet. Movement of the film sheet by the eccentric drives to position one reveals a first pixel of each six pixel group within the film sheet (FIG. 12). Movement of the film sheet by the eccentric drives to a second position reveals a second pixel of each pixel group (FIG. 13). Movement of the film sheet by the eccentric drives to a third position reveals a third pixel of each six pixel group (FIG. 14). Movement of the film sheet to a fourth position reveals a fourth pixel of each six pixel group (FIG. 15). Movement of the film sheet to a fifth dwell position reveals a fifth pixel of each six pixel group (FIG. 16). Movement of the film sheet to a sixth and final position of the sequential circuit reveals a sixth pixel of each six pixel group within the film sheet (FIG. 17).

It will be appreciated to those skilled in the art that numerous different configurations for the pixels and sets of pixels may be adopted wherein the pixels themselves may be located on a path defined by a continuous loop about which the eccentrics may dictate travel of the film screen.

From the foregoing, it will be appreciated that the improved display apparatus associated with the present invention provides a precise advancement of a mosaic film sheet along a predetermined closed sequential loop registering discrete images within the mosaic with apertures defined by an overlying grid sheet to project the images. The improved display apparatus employs a controllable stepper motor positively coupled to eccentric drives to move the film sheet through its circuit precisely stopping at programmed dwell points without slippage or lag. This allows registration of the entire pixels within each pixel set of the film sheet within equally dimensioned apertures in the grid sheet giving a higher resolution image and more precise alignment than known before.

While a particular form of the invention has been illustrated and described, it will be apparent that various modifications can be made without departing from the spirit and scope of the invention.

What is claimed is:

1. An advertising display apparatus for displaying a series of discrete images in sequence, and comprising:

a housing including an illumination source;

a platen overlying said illumination source and formed with a central window for projection of light from said source;

a film sheet overlying said platen and formed by a plurality of independent images, each formed by spaced apart sets of a selected number of predetermined sized pixels interlaced with and spaced from one another to, in each said set, form a common pattern with corresponding pixels of each said set correspondingly located and the corresponding pixels of each set disposed at selected dwell points along a predetermined rotary path, said film sheet being moveable through said predetermined rotary path;

a grid sheet overlying said film sheet and formed with a pattern corresponding with the location and size of said selected number of predetermined sized pixels and including transparent apertures repetitively interlaced in said pattern corresponding with the correspondingly located pixel of each said set;

a step drive motor mounted in said housing and including a drive sprocket wheel;

a pair of spaced apart eccentric drives mounted from said housing, engageable with said film sheet, and operative to, upon rotation thereof, translate said film sheet through said predetermined rotary path to advance said sets of pixels to sequentially register with said corresponding apertures;

a pair of non-distensible coupling links coupling said sprocket wheel to said eccentric drives to positively rotate said eccentric drives in unison with rotation of said sprocket wheel; and a control device for advancing said step drive motor in predetermined increments sufficient to cause said coupling links to incrementally and sequentially advance said eccentric drives in incremental amounts sufficient to shift said film sheet through said predetermined rotary path to said dwell points to cause said coupling links to positively stop said film sheet at the respective said dwell points with said apertures aligned over the respective corresponding pixels of said sets.

2. A display apparatus as recited in claim 1 wherein:

said step drive motor includes a DC motor, an electrical circuit within said DC motor operative to control said step drive motor to rotate said drive shaft at a predetermined rate and to stop at said selected dwell points; and said control device includes means for selecting said predetermined rate and said selected dwell points.

3. A method of displaying an image from a film sheet formed by a plurality of independent images, each formed by spaced apart sets of a selected number of predetermined sized pixels interlaced with and spaced from one another to, in each set, form a common pattern with corresponding pixels of each said set correspondingly located and the corresponding pixels of each set disposed at selected dwell points along a predetermined rotary path adjacent a grid sheet formed with a pattern corresponding with the location and size of said selected number of predetermined sized pixels and including transparent apertures repetitively interlaced in said pattern corresponding with the correspondingly located pixel of each said set, said method comprising the steps of:

providing a display apparatus including a housing with an illumination source, a platen having a window, an eccentric drive mounted on said housing, a step drive motor coupled to said eccentric drive, and a control device for advancing said drive motor incrementally for driving said eccentric drive in a predetermined rotary path;

mounting said film sheet movably on said platen;

anchoring said grid sheet on said housing over said platen; and connecting said film sheet to said eccentric drive, and actuating said step drive motor to drive said eccentric drive directly in one direction to sequentially advance said film sheet through a predetermined rotary path to sequentially align said grid sheet apertures with the corresponding pixels of said sets, and stopping said step drive motor at said dwell points to stop said film sheet with said corresponding pixels of said sets in alignment with said grid sheet apertures.

4. An advertising display apparatus for displaying a series of discrete images in sequence, and comprising:

a housing including an illumination source;

a platen overlying said illumination source and formed with a central window for projection of light from said source;

a film sheet overlying said platen and formed by a plurality of independent images, each formed by spaced apart sets of a selected number of predetermined sized pixels interlaced with and spaced from one another to, in each set, form a common pattern with corresponding pixels of each said set correspondingly located and the corresponding pixels of each set disposed at selected dwell points along a predetermined rotary path, said film sheet being moveable through a predetermined path including selected dwell points;

a grid sheet overlying said film sheet and formed with a pattern corresponding with the location and size of said selected number of predetermined sized pixels and including transparent apertures repetitively interlaced in said pattern corresponding with the correspondingly located pixel of each said set; and a driver directly coupled to said film sheet and operative to shift said film sheet through said predetermined rotary path to advance said sets of pixels to sequentially register with said grid sheet apertures.

5. A display apparatus as recited in claim 4 wherein said platen includes a curved surface, and having:

tensioning means anchoring said grid sheet under tension to said housing in overlying relation to said film sheet to hold said film sheet to said curved surface of said platen.

6. A display apparatus as recited in claim 4 further including:

a lubricant coated on said film sheet for reducing the coefficient of friction of said film sheet.

7. A display apparatus as recited in claim 4 wherein:

said film sheet is formed with a pair of spaced apart bores; and said driver includes a pair of spaced apart mounting pins moveable through said predetermined rotary path and removably engageable in the respective said bores.

8. A display apparatus as recited in claim 4 wherein:

said film sheet is further formed with said sets of pixels arrayed so that said rotary path is about 1 mm in diameter; and said eccentric drive is configured to orbit said film sheet in a circle having a diameter of substantially 1 mm.

9. A display apparatus as set forth in claim 4 wherein:

said film sheet sets of pixels are arranged in a square pattern; and said eccentric drive is operative to, upon actuation of said drive motor, cause relative rotary movement between said grid sheet and said film sheet.

10. A display apparatus as set forth in claim 4 wherein:

said film sheet sets of pixels are arranged in a predetermined circular configuration; and said eccentric drive is operative to relatively translate said film sheet and said grid sheet through a circular path corresponding with said predetermined circular configuration.

11. A display apparatus as set forth in claim 10 wherein said pixels are arranged in sets of six configured in a hexagonal pattern; and said control device is operative to stop said drive motor when said eccentric drive relatively positions said film and grid sheets at respective dwell points corresponding with the respective pixel arrangement of said hexagonal pattern.

12. A display apparatus as recited in claim 11 wherein:

said eccentric drive is operative to relatively translate said film sheet and said grid sheet in a circle.

13. An advertising display apparatus for displaying a series of discrete images in sequence, and comprising:

a film sheet formed by a plurality of independent images, each formed by spaced apart sets of a selected number of predetermined sized pixels interlaced with and spaced from one another to, in each set, form a common pattern with corresponding pixels of each said set correspondingly located, said pattern defining a plurality of selected dwell points along a predetermined rotary path, and the corresponding pixels of each set disposed at said selected dwell points;

a grid sheet formed with a pattern corresponding with the location and size of said selected number of predetermined sized pixels and including transparent apertures repetitively interlaced in said pattern corresponding with the correspondingly located pixel of each said set, said grid sheet cooperating with said film sheet in overlaying parallel proximal relation to form a masking mechanism for selectively aligning said apertures with said sets of pixels following said predetermined rotary path to sequentially form images responsive to relative rotary movement therebetween, said apparatus comprising:

a housing including an anchor device for fixedly mounting said masking mechanism;

an eccentric drive mounted on said housing, engageable with said masking mechanism, and operative to, upon rotation thereof in one direction, cause relative rotary movement between said grid sheet and said film sheet through said predetermined rotary path to register said apertures sequentially over said corresponding pixels;

a step drive motor mounted on said housing and including a drive shaft advanceable in discrete precise steps, said drive shaft having an initial home position;

a coupling device coupling said drive shaft directly to said eccentric drive for rotation in one direction to rotate said eccentric drive; and a control device for advancing said step drive motor in predetermined increments sufficient to cause said coupling device to incrementally and sequentially advance said eccentric drive in incremental amounts sufficient to cause relative rotary movement between said grid sheet and said film sheet through said predetermined rotary path to said dwell points to cause said coupling device to positively stop relative movement of said film and grid sheets at the respective said dwell points with said apertures aligned over the respective corresponding pixels of said sets.

14. A display apparatus as recited in claim 13, that includes:

a platen mounted in said housing and formed with a window for projection of light to intersect with said masking mechanism; and a light source for generating light for projection through said window.

15. A display apparatus as recited in claim 13, wherein:

said anchor device includes a pair of anchor pegs mounted on either side of said housing and one of said pegs being spring loaded outwardly away from the other of said pegs; and said masking mechanism includes anchor devices disposed on the opposite sides thereof, including mounting holes for fitting over the respective said anchor pegs.

16. A display apparatus as recited in claim 13 wherein said eccentric drive includes:

a cylindrical wheel formed with an outwardly facing surface and rotatable about a central axis, said wheel including an eccentrically located bearing cavity bored eccentric to said central axis a distance corresponding substantially to one-half the width of said pixels and a mounting pin centrally mounted rotatably in said bearing cavity and projecting therefrom to engage said masking mechanism.

17. A display apparatus as recited in claim 13, further comprising:

a transmitter mounted adjacent said step drive motor to transmit an index signal;

a receiver mounted adjacent said transmitter in spaced relation to form therebetween a path to receive said index signal when transmitted along said path and operative in response thereto to generate a receiver signal to be communicated to said control device;

a circular index wheel mounted on said drive shaft and projecting in said path to movably block transmission of said index signal along said path and including an index notch for passing said index signal along said path;

said control device is electrically coupled to said step drive motor and operative to transmit a command pulse thereto to advance said drive shaft one of said discrete precise steps;

a memory in said control device;

a counter in said control device for counting each said command pulse passed to said step drive motor and responsive to a predetermined number of said command pulses being passed to said step drive motor to generate a reset signal;

a controller in said control device responsive to said reset signal to generate a transmit signal;

said transmitter is responsive to said transmit signal to generate said index signal;

a logic circuit in said control device responsive to both said reset signal and to the absence of said receiver signal to generate a find home signal;

a find home circuit in said control device responsive to said find home signal to generate said command pulse to be communicated to said step drive motor;

said seep drive motor is responsive to said command pulse to rotate said index wheel;

a detector circuit in said control device responsive to both said find home signal and said receiver signal to terminate said command pulses to said step drive motor and to generate a stop signal; and a recorder in said control device responsive to said stop signal to record the position of said drive shaft in said memory as a new home position of said drive shaft.

18. A display apparatus as recited in claim 17 further comprising:

a lubricant coated on said masking mechanism for reducing the coefficient of friction thereof.

19. An advertising display apparatus for displaying a series of discrete images in sequence, and comprising:

a film sheet formed by a plurality of independent images, each formed by spaced apart sets of a selected number of predetermined sized pixels interlaced with and spaced from one another to, in each set, form a common pattern with corresponding pixels of each said set correspondingly located and the corresponding pixels of each set disposed at selected dwell points along a predetermined rotary path, said film sheet formed with a pair of mounting holes spaced apart a predetermined distance;

a grid sheet formed with a pattern corresponding with the location and size of said selected number of predetermined sized pixels and including transparent apertures repetitively interlaced in said pattern corresponding with the correspondingly located pixel of each said set, and including anchor apertures disposed on its sides;

a housing including an anchor device to engage said anchor apertures for fixedly mounting said grid sheet;

a platen for supporting said film sheet;

an eccentric drive including a cylindrical wheel formed with an outwardly facing surface and rotatable about a central axis, said wheel including an eccentrically located bearing cavity bored eccentric to said central axis a distance corresponding substantially to one-half the width of said pixels and a mounting pin centrally mounted rotatably in said bearing cavity and projecting therefrom to engage said film sheet and mounted on said housing, engageable with said film sheet, and operative to, upon rotation thereof in one direction, translate said film sheet through said predetermined rotary path to selectively align said apertures over the selected corresponding pixels of said sets;

a step drive motor mounted on said housing and including a drive shaft advanceable in discrete precise steps, said drive shaft having an initial home position;

a coupling device coupling said drive shaft directly to said eccentric drive for rotation in one direction to rotate said eccentric drive; and a control device for advancing said step drive motor in predetermined increments sufficient to cause said coupling device to incrementally and sequentially advance said eccentric drive in incremental amounts sufficient to shift said film sheet through said predetermined rotary path to cause said coupling device to positively stop said film sheet with said apertures aligned over the respective corresponding pixels of the respective said sets.

20. A display apparatus as recited in claim 19 wherein:

said eccentric drive includes a pair of spaced apart rotatable wheels mounted on said housing including a respective eccentrically located mounting pin spaced apart said predetermined distance for close fitting receipt in the respective said mounting holes.

21. A display apparatus as recited in claim 20 wherein:

said step drive motor includes a drive shaft mounting a pair of drive sprockets and said coupling device includes a pair of inelastic links connecting said drive sprockets to the respective said rotatable wheels.

22. A display apparatus as recited in claim 21 wherein:

said links are in the form of a pair of timing belts.

23. A display apparatus as recited in claim 22 wherein:

said drive sprockets are formed with peripheral toothed grooves having sprocket teeth; and said timing belts are formed with belt teeth configured to mesh with said sprocket teeth.

24. A display apparatus as recited in claim 22 that includes:

a pair of guides mounted on said housing and engaged with said timing belts to guide the respective said timing belts onto the respective said drive sprockets.

* * * * *